United States Patent [19]

Aston

[11] 4,322,999

[45] Apr. 6, 1982

[54] STABILIZING VENT SYSTEM FOR GUN BARRELS

[76] Inventor: Thomas M. Aston, 928 N. Third, Cottonwood, Ariz. 86326

[21] Appl. No.: 66,290

[22] Filed: Aug. 13, 1979

[51] Int. Cl.[3] ..... F41C 21/18

[52] U.S. Cl. ..... 89/14 C

[58] Field of Search ..... 42/1 V, 76 R; 89/14 R, 89/14 C, 42 R

[56] References Cited

U.S. PATENT DOCUMENTS

| | | | |
|---|---|---|---|
| 785,972 | 3/1905 | McClean | 89/14 C |
| 1,259,251 | 3/1918 | Love | 89/14 C |
| 1,363,058 | 12/1920 | Schneider | 89/14 C |
| 2,206,568 | 7/1940 | Hughes | 89/14 C |
| 2,322,370 | 6/1943 | Lance | 89/14 C |
| 3,368,453 | 2/1968 | Shaw | 89/14 C |
| 3,808,943 | 5/1974 | Kelley | 89/14 C |

OTHER PUBLICATIONS

Thomas J. Hayes, Elements of Ordnance, 1938, pp. 199–200.

*Primary Examiner*—Stephen C. Bentley

*Attorney, Agent, or Firm*—Cahill, Sutton & Thomas

[57] ABSTRACT

The vent system for reducing the recoil, jump, blast, noise and flash of a discharging firearm includes: a plurality of sets of forwardly directed longitudinally aligned vents disposed equiangularly about in the barrel to discharge a portion of the propellant gases laterally and forwardly; annular equalizing chambers interconnecting a vent of one set of vents with a corresponding vent in each of the other sets of vents; a longitudinal flute diametrically opposed to each set of vents and interconnecting the equalizing chambers; and, a set of generally upwardly directed thrust orifices interconnecting with selected ones of the equalizing chambers.

35 Claims, 13 Drawing Figures

STABILIZING VENT SYSTEM FOR GUN BARRELS

The present invention relates to firearms and, more particularly, to a vent system for stabilizing gun barrels.

On the discharge of any firearm, there exists a certain amount of recoil, jump, whip, blast, noise and flash. In large caliber hand guns, the recoil, jump and whip are of exceptionally large magnitude because of the relatively light weight of the firearm with respect to the power of the discharged propellant gases and the projectile weight. The quantity of blast, noise and flash have some physical, but primarily psychological, impact upon the shooter and tend to cause him to tense in anticipation of the discharge and to flinch upon discharge; both reactions contribute to inaccurate shooting. The blast, noise and flash also have the obvious effects of immediately identifying the location of the firearm, which identification may be disastrous in a war time environment.

In the prior art, various attempts have been made to modify, alter or otherwise construct firearms for the purpose of minimizing one or more of the above recited inherent characteristics. U.S. Pat. No. 785,979 is directed to the construction of a gun barrel having a plurality of rearwardly directed ports in fluid communication with a series of circumferential grooves or with a gradually deepening spiral groove within the bore. The reversed gas flow direction necessarily offers resistance to the gas flow and has a negative effect upon the velocity of the projectile. The rearwardly directed discharge gases strike the firearm user with obvious negative effects. Because of the small sized ports, a noise increase rather than a reduction, is probable. U.S. Pat. No. 812,140 discloses the use of radially oriented small diameter ports extending radially from the grooves of the barrel rifling. With the use of threadedly engageable plugs, a portion of the discharge gases can be directed forwardly to vent at the end face of the barrel. Because of the small and inefficiently sized ports, the noise may be increased and recoil reduction would be minimal, if any. U.S. Pat. No. 1,628,896 is directed to a gun barrel having a plurality of forwardly oriented independent slots extending throughout the length of the barrel. The resulting continuous loss of propellant gases as the projectile travels down the barrel, severely reduces the muzzle velocity of the projectile. Moreover, the blast occuring throughout the length of the barrel endangers both the user and bystanders.

U.S. Pat. No. 2,075,837 is directed to an attachment for firing blank cartridges through automatic guns and venting the blast laterally. U.S. Pat. No. 2,206,568 is directed to an attachment mounted at the muzzle of a gun barrel to direct the propellant gases rearwardly. The sudden pressure changes adjacent the projectile without having the projectile supported by rifling in the barrel severely impairs the predictability of the projectile trajectory. Moreover, the rearwardly directed discharge gases will strike the user and produce attendant physical danger and distress to him. See also U.S. Pat. No. 2,212,685. U.S. Pat. No. 2,466,104 discloses a variable choke for shot guns to vary the pattern of the discharged shot. U.S. Pat. No. 3,808,943 illustrates upwardly oriented vents for minimizing muzzle jump and recoil. To prevent an increase in noise level and to prevent directing the flash toward the user, the patentee states that the cross sectional area of the slots must be equal to or greater than the area of the bore. U.S. Pat. No. 4,126,077 is directed to a means for accommodating an air inflow into the barrel behind the projectile on separation thereof from the shell.

It is therefore a primary object to provide a balanced integrated stabilizing system for reducing the recoil, jump, blast, noise and flash attendant a firearm.

Another object of the present invention is to increase the accuracy of hand guns by reducing the jump, recoil and whip on discharge of the projectile.

Still another object of the present invention is to reduce the recoil of a firearm by at least twenty-five to forty-eight percent.

Yet another object of the present invention is to dissipate the muzzle blast and reduce most of the muzzle flash attendant firearms.

A further object of the present invention is to direct the discharge noise of a firearm away from the user.

A yet further object of the present invention is to provide a self-scouring vent system for barrels.

A still further object of the present invention is to provide an integrated vent system in the barrel of a firearm which also supports the projectile on passage thereof past the vent system.

Other objects of the present invention will become apparent to those skilled in the art as the description thereof proceeds.

The present invention will be described with greater specificity and clarity with reference to the following drawings, in which.

Figure 6:
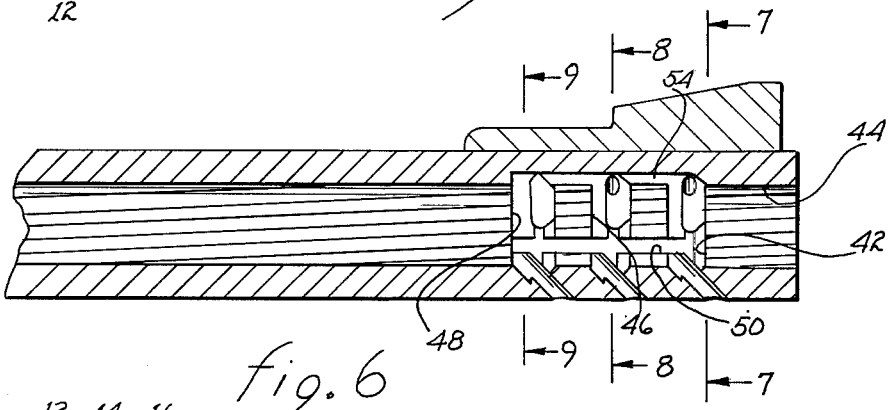
FIG. 6 is a cross-sectional view taken along lines 3—3, as shown in FIG. 2.
Figure 7:
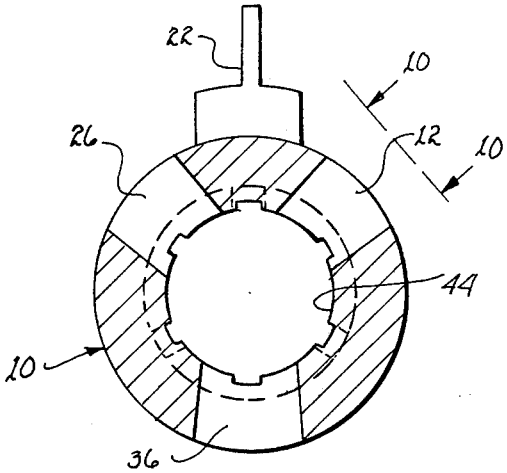
FIG. 7 is a cross-sectional view taken along lines 7—7, as shown in FIG. 6.
Figure 8:
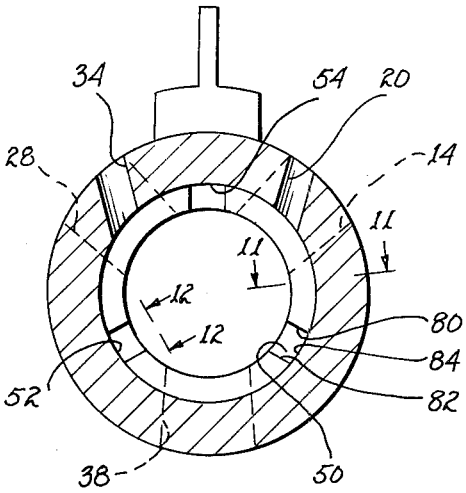
Figure 9:
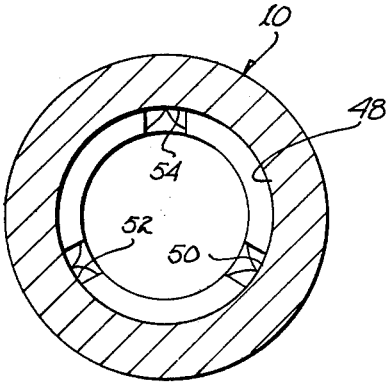
Figure 10:
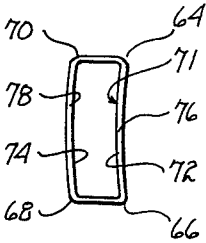
Figure 11:
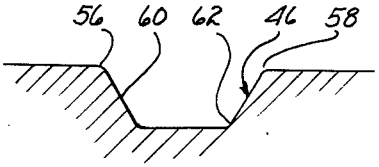
Figure 13:
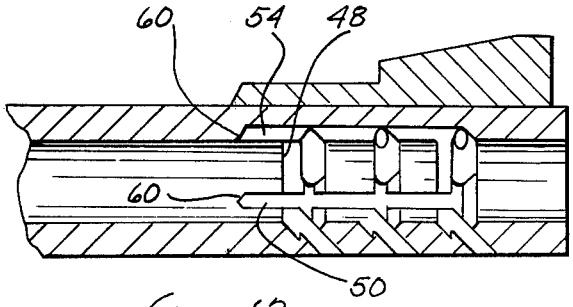
Figure 12:
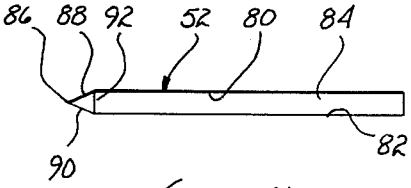

FIG. 8 and are cross-sectional views taken along lines 8—8, as shown in FIG. 6;

FIG. 9 is a cross-sectional view taken along lines 9—9, as shown in FIG. 6;

FIG. 10 is a plan view taken along lines 10—10, as shown in FIG. 7;

FIG. 11 is a cross-sectional view taken along lines 11—11, as shown in FIG. 8;

FIG. 12 is a plan view taken along lines 12—12, as shown in FIG. 8; and FIG. 13 illustrates a variant of the present invention.

As indicated by the prior art reviewed above, various attempts have been made to reduce one or more of the effects of the recoil, jump, whip, blast, noise and flash attendant firearms. However, the known prior art teachings have considered only solutions limited to one or another problem and have never considered a comprehensive solution to the integrated and interrelated problems attendant the discharge of the propellant gases. Moreover, some of the prior art teachings only ameliorate the symptons instead of curing the underlying problems. That is, there exists no teachings in the prior art which will induce the least possible flow resistance to the discharge gases while maintaining the projectile speed and trajectory simultaneous with the controlled dissipation of a maximum volume of propellant gases. To achieve these results, calibrated metering orifices must be employed which exert directional control over the discharge gases of the propellant. Moreover, each individual firearm or firearm type must be considered to attain the highest percentage effectiveness and such effectiveness can only be achieved by creating a flow control based upon engineering analysis to dictate the size, shape, volume, placement and orientation of each vent or port attendant a vented balanced integrated stabilizing system for firearms.

Figure 1:
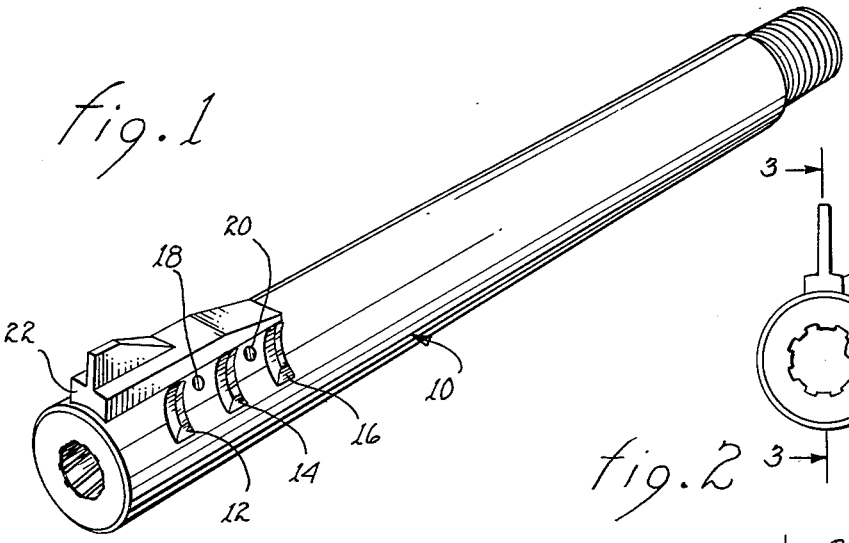
FIG. 1 is a perspective view of a barrel incorporating an integrated vent stabilizing system.

Referring to FIG. 1, there is shown a barrel 10 incorporating an embodiment of the present invention. In the embodiment illustrated, a first set of three longitudinally aligned laterally forwardly directed vents 12, 14 and 16 are oriented approximately 60° off vertical. Interleaved with these vents are ports 18 and 20 to direct the discharge gases essentially directly upwardly, as will be described in further detail below. A second and third set of vents are also developed within barrel 10 and the three sets of vents are equiangularly located about the longitudinal axis of barrel 10. Additionally, a second set of ports, duplicative of ports 18 and 20, are disposed on the other side of sight 22.

Figure 2:
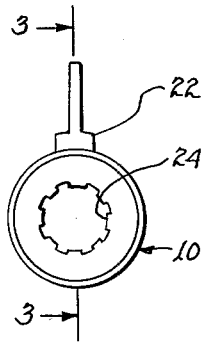
FIG. 2 is an end view of the barrel.

As depicted in FIG. 2, barrel 10 is rifled such that each of a plurality of lands 24 support the projectile during its passage through the bore, which lands tend to impart rotation to the projectile about its longitudinal axis during passage through the bore of the barrel.

Figure 5:
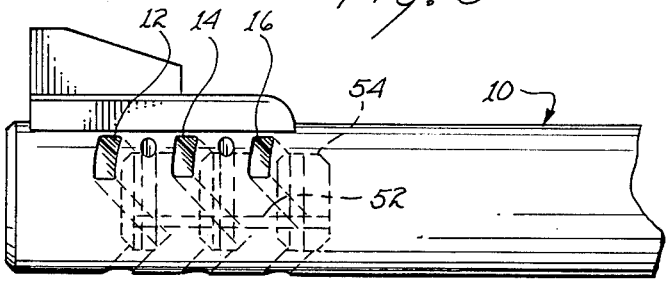
FIG. 5 is a side view of the barrel.
Figure 4:
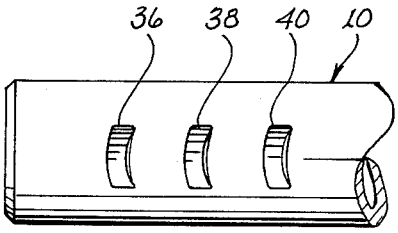
FIG. 4 is a bottom view of the barrel.
Figure 3:
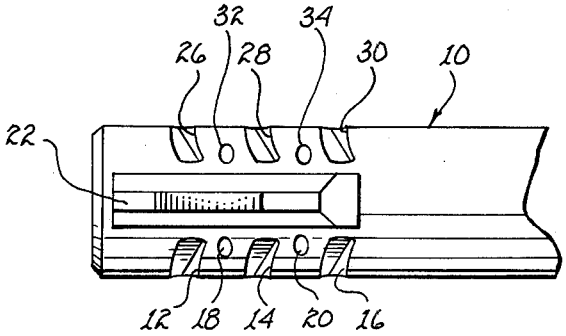
FIG. 3 is a top view of the barrel.

FIGS. 3, 4 and 5, depict a second set of laterally forwardly directed vents 26, 28 and 30 disposed in barrel 10 and oriented approximately 60° off vertical. A second set of upwardly directed ports 32 and 34 are interleaved with the vents of the second set to direct the discharge gases essentially directly upwardly. A third set of laterally forwardly directed vents 36, 38 and 40 are disposed in general alignment with the bottom center line of barrel 10. Thereby, the three sets of vents are essentially equiangularly disposed about the barrel.

Each vent of each set of vents is centered upon and aligned with a radial of barrel 10. The angular forward orientation of each of the vents with respect to the longitudinal axis of the barrel is in the range of 45°–60°. To minimize flow restriction through each of the vents, the corners 64, 66, 68, 70 thereof are radiused. See FIGS. 3–10

For handguns having a high thrust line, the bottom set of vents may be deleted. However, the decision of whether to include the bottom set of vents must be primarily predicated on empirical data combined with technical analysis of each handgun type and caliber.

To accomodate the expansion of the propellant gases, the vents may be wedged shaped. It has been found that the wedge angle of each vent surface may range from 1° to 10° with respect to a radial. Considerations such as area of the barrel, location and size of the forward sight, ribs aligned on the barrel, etc. may have a mitigating factor in limiting the wedge angle.

Similarly, ports 18, 20 and 32, 34 define inverted truncated cones to accomodate the expected expansion of the propellant gases. Nominally, the cone angle may be approximately 3°. The diameter of the ports is also a function of the proximity of the sight ramp, the probability of deposition of contaminants on the sight and the proximity of the adjacent vents.

As illustrated in FIGS. 5, 6, 7 and 8, the inlets to vents 12, 26 and 36 are in fluid communication with one another through an annular equalizing chamber 42 formed within bore 44. Similarly, the inlets to vents 14, 28 and 38 are in fluid communication with one another through annular equalizing chamber 46 formed within the bore. And, the inlets to vents 16, 30 and 40 are in fluid communication with one another through annular equalizing chamber 48 formed within the bore.

Equalizing chambers 42, 46 and 48 define a trapezoid in cross section, as shown in FIG. 11 for equalizing chamber 46. The maximum width of the equalizing chamber is equivalent to one half or less of the length of the bearing surface of the projectile to ensure adequate support of the projectile as it traverses the equalizing chamber. Annular edges 56, 58 are chamfered to preclude scraping of the projectile. Side walls 60, 62 slope at an angle of approximately 45°. The depth of the equalizing chamber should be limited to a dimension of one half or less of the wall thickness of the barrel, as measured from the rifling grooves to the exterior surface.

The width of inlet 71 (See FIG. 10) of each vent should be equal to or slightly less than the width of the base of the respective equalizing chamber in fluid communication therewith. The length of the inlet is thereafter determined by limiting it to a length, (chord length) smaller than the bore diameter, such that the inlet area of each vent is one third of 2.6 times the area of the bore. The angular orientation of each vent with respect to the longitudinal axis of the barrel commensurate with the intersection with the respective equalizing chamber results in a curvature of the inlet edges 72, 74 of walls 76, 68 of the vents. This curvature is maintained by the walls, as depicted in FIG. 10.

Diametrically opposed to each set of vents, there is formed a longitudinally oriented flute recessed within bore 44. That is, flute 50 is diametrically opposed to the first set of vents, flute 52 is diametrically opposed to the second set of vents and flute 54 is diametrically opposed to the third set of vents. Each flute is centered upon and aligned with a radial of barrel 10.

The side walls 80, 82 of each flute (See FIG. 8) match in depth the depth of the equalizing chambers; i.e. one half of the wall thickness of the barrel. The width of base 84 is a function of the bore diameter and may vary between 1/16 to $\frac{1}{8}$ of the circumference of the bore. With these dimensions, and those of the vents, the width of the bore area defining the surface separating the flute from the adjacent vent inlets is 0.010 of an inch or less.

In a variant of the present invention, the flutes 50,52 and 54 may extend rearwardly of equalization chamber 48, as depicted in FIG. 12. Through such extension, the propellant gases will begin to flow therethrough into each of the equalization chambers on passage of the rear of the projectile therepast and prior to clearing by the projectile of the first and subsequent equalization chambers. The resulting pressurization of the equalizing chambers will have a tendency to initiate a relatively rapid flow through the respective vents prior to impingement thereon of the full force and effect of the propellant gases. The resulting preflow offers less of a resistance than an initial nonflow therethrough on impingement of the bulk of the propellant gases. Accordingly, the flow rate is expedited and the effectiveness of the laterally dissipated propellant gases is increased. Tests have indicated that the jump is reduced by these extensions, which is of significant importance in firearms having short barrels and a limited moment arm for the thrust orifices.

The upstream end, inlet 60, of the flutes may be defined by a vertically oriented wall or may be sloped, as illustrated in FIGS. 9 and 10. In the sloped configuration, side walls 80, 82 bend toward one another and meet at apex 86. Simultaneously, base 84 slopes upwardly to intercept the bore surface at apex 86. Edges 88 and 90, commensurate with the bent side walls, are chamfered to smooth the air flow into the flute. Similarly, intersection 90, defining the beginning of the sloping base is chamfered to smooth the air flow into the flute.

By employing a sloped entry into the flutes, the shock resulting from the sudden expansion of the propellant gases into the flutes is reduced. And, the probability of deformation to the projectile is commensurately reduced. Moreover, with the sloped entry, inlet 60, the propellant gases impinging thereon will tend to be accelerated. Such acceleration will tend to more rapidly fill the flute with propellant gases resulting in more rapid distribution of the gases within the respective interconnected equalizing chambers and attendant vents and ports. Accordingly, discharge of the propellant gases will be accelerated in time such that discharge may be occuring even while the projectile is passing past the respective inlets of various vents.

By experiment it has been learned that the flutes may be coincident with, rather than diametrically opposed to, the inlets of each set of vents, as shown in FIG. 8*a*. With this location of the flutes, tests indicate that dissipation of the porpellant gases may be somewhat more rapid.

Ports 18, 20, 32 and 34 are disposed within a radial plane and angularly oriented at an angle of approximately 15° with respect to vertical. The inlet to port 18 is in general intersection with the rear surface of vent 12 in proximity to equalizing chamber 42. The inlet to port 32 is in general intersection with the rear surface of vent 26 in proximity to equalizing chamber 42. The inlet to port 20 is in general intersection with the rear surface of vent 14 in proximity to equalizing chamber 46. And, the inlet of port 32 is in general intersection with the rear surface of vent 26 in proximity to equalizing chamber 46. The diameter of these ports, or thrust orifices, is a function of the distance between adjacent vents, the sight mount width and bore thickness.

By tests, it has been determined that the thrust orifices reduce the "jump" of the firearm by more than one half of its former value.

As noted above, the size, shape, volume and placement of each of the vents are relatively important in order to obtain a balanced stabilizing venting system for a firearm. In example, where three vents are employed in each set of vents, the total area at the vent inlets should be approximately 8.615 times the area defined by the bore diameter. Were five vents per set of vents employed, the total area of the vent inlets should be approximately 14.3 times the area defined by the bore diameter. These figures are devised from a determination that each group of three equiangularly oriented vent inlets should define an area of 2.6 times the area defined by the bore diameter. The figure of 2.6 has, in turn, been derived through analysis of the various parameters attendant stabilization of firearms.

As particularly depicted in the drawings, it may be noted that the lands attendant the rifling are intact except where such lands are coincident with either the inlets to the vents, the inlets to the ports, the equalizing chambers or the flutes. Despite the resulting removal of segments of these lands, the projectile is fully supported by the remaining lands as it traverses the area attendant the vents and ports. Thus, the "spin" imparted to the projectile by the preceding rifling is not interrupted and is in fact continually urged as the projectile traverses the vented segment of the barrel.

In operation, as the rear of the projectile begins its passage across the first equalizing chamber 48, the propellant gases immediately fill the void defined thereby and present a uniform pressure at the inlet to each of vents 16, 30 and 40. In addition, the propellant gases flow through each of flutes 50, 52 and 54 to equalizing chambers 46 and 48 to establish a commensurate pressure environment at the inlets of the vents associated therewith. The resulting pressure gradient extent at the inlet of each of the vents in each of the set of vents results in a commencement of flow of propellant gases therethrough and discharge thereof at the outlets of the vents prior to exit of the projectile from the muzzle of the barrel.

It is well known through high speed photography that upon exit of the projectile from the muzzle, the sudden release of propellant gases may cause deformation of the rear end of the projectile. Such deformation is undesirable as it affects the trajectory of the projectile. By initiating release of the propellant gases prior to the exiting of the projectile, the "burst" of the propellant gases at the muzzle is substantially reduced and deformation of the projectile will not occur.

The dissipation of the propellant gases through the various vents will reduce the magnitude of the force of the discharging gases. Commensurately, the effect of the "blast" attendant the discharge will be dissipated. With dissipation of the blast, the amount of "flash" attendant any vent or the muzzle will be substantially reduced. In fact, tests show the flash to become so divided that it is extinguished within the vents; no visible part of the flash will extend beyond the barrel itself. Thus, in war time environments or other environments wherein detection of the location of the discharging firearm by sight may be disastrous, the present invention vitiates such danger. Additionally, the dissipation of the blast results in a reduction of both the sharpness and loudness of the noise normally attendant the firearm to the extent that injury to the user is very unlikely even without earplugs or ear muffs. This is of substantial benefit to users who repeatedly fire 0.357 and 0.44 caliber magnum handguns.

Simultaneous with the flow of propellant gases to the equalizing chambers and through the vents, a portion of the propellant gases will begin to flow through ports 18, 20 and 32, 34 for discharge through the respective outlets thereof.

The discharge from the generally vertically oriented ports or thrust orifices is essentially vertical to counteract the jump normally attendant firearms, as described above. However, to prevent blast in proximity to the user, the thrust orifices are located forwardly of the rear most group of vents. Thereby, the discharging propellant gases from the thrust orifices will mingle with and be deflected forwardly by the much greater volume of discharge gases exiting through the vents immediately rearwardly thereof. Thereby, all discharging gases will have a component of forward velocity away from the user.

As may be deduced from the drawings, the air flow transition into the vent system is devoid of obstructions and the propellant gases will not tend to stagnate within any of the vents or ports. Thus, upon discharge of the firearm, the propellant gases will have the effect of scouring the vents and ports to maintain them essentially free of obstructive deposits.

A tangential benefit of the stabilizing system described above and possibly not immediately apparent is that of reducing the air resistance to the projectile traveling through the bore. In conventional barrels, the air in front of the traveling projectile must be forced out the muzzle and therefore presents a resistance to acceleration of the projectile. With the vents and ports described herein, such air pressure will be dissipated short of the muzzle and hence present a lowered resistance to the accelerating projectile resulting in increased muzzle velocity of the projectile.

The location of the vent system with respect to the muzzle is dependent upon several parameters. The vent system should be as close as possible to provide the greatest moment arm to the forces produced by the thrust orifices to counteract the "jump". Yet, sufficient rifling must be retained downstream of the vent system to insure adequate guiding of the projectile and prevent wobbling of the projectile.

The duration of acceleration of a projectile within the barrel is a function of the quantity of propellant, burn rate of the propellant and mass of the projectile, all of which must be commensurate with the strength of the barrel. Normally, the maximum velocity of the projectile is reached well before the projectile reaches the muzzle and the end segment of the barrel serves primarily to guide the projectile by imparting a stabilizing spin to it. From tests, it has been determined that the stabilizing vent system described hereinabove will not affect the muzzle velocity of the projectile. Hence, the kinetic energy attendant the projectile on discharge from the firearm is not impaired and the projectile trajectory will remain true as the rifling has not been substantially impaired.

Recoil in firearms has two stages. The first stage is incurred upon the rapid burning or explosion on ignition of the propellant. The amount of recoil force imposed upon the user is a function of the weight of the firearm, the weight of the projectile and the magnitude of the explosion. The second stage is incurred upon discharge of the propellant gases from the muzzle. The amount of the recoil is a function of the quantity and pressure of the propellant gases and the abruptness of the discharge. There is little that can be done to reduce the effect of the first stage of recoil as the firearm, projectile and propellant load are selected for the type of firing to be done. However, the second stage of recoil can be substantially ameliorated (25–48% by test) and such amelioration is accomplished by the vent system of the present invention. The dissipation of the blast resulting from passage of the propellant gases radially and longitudinally with respect to the barrel eliminates concentration of the blast in one direction. Hence, the second stage of recoil is substantially diminished.

By ejecting the propellant gases laterally equiangularly a stabilizing force is established to counteract the tendency of the firearm to whip. The reduced tendancy to whip, in turn, stabilizes the firearm as a platform and increases its accuracy. Moreover, there will exist a lesser tendency for the user to attempt to tense in anticipation of the whip and accuracy is enhanced.

By various tests, it has been learned that the present invention can be used with great benefit in firearms such as the Colt 0.45 automatic. In such a firearm, the barrel is modified as described above. In addition, the slide is modified to incorporate vents coincident and aligned with the vents in the barrel. As the slide may begin its travel prior to near complete expulsion through the barrel vents of the propellant gases, the vents in the slide may be somewhat elongated along the axis of the barrel in order to accommodate slight movement of the slide without constriction of the propellant gas discharge. The parts described above may also be incorporated in such automatic firearms.

Usually, because of the springs and other mechanisms coincident with the underside of the barrel, the vents may be positionally limited to the upper side of the barrel.

The above recited benefits have been achieved with automatic firearms when modified in accordance with the principles of the present invention. In particular, the well known loud and sharp report of a Colt 0.45 has been substantially toned down and the well known jump has been reduced to very acceptable levels, resulting in great accuracy during rapid fire.

While the present invention was primarily conceived and reduced to practice for use with hand guns because of the inherent instability of hand guns on discharge, utilization of the present invention on other firearms, such as rifles, various military firearms, artillery pieces, etc., will enhance the accuracy of such firearms without any attendant detriments to muzzle velocity or trajectory.

While the principles of the invention have now been made clear in an illustrative embodiment, there will be immediately obvious to those skilled in the art many modifications of structure, arrangement, proportions, elements, materials and components, used in the practice of the invention which are particularly adapted for specific environments and operating requirements without departing from those principles.

I claim:

1. A stabilizing vent system incorporated in and as part of a barrel of a firearm for venting the barrel on discharge of the firearm, said vent system comprising in combination:

(a) three sets of vents disposed within the barrel and about the longitudinal axis of the barrel for balancing the force of the dissipating propellant gases in the lateral plane of the barrel each said set of vents including at least two vents in general alignment with each other along the longitudinal axis of the barrel;

(b) an equalizing chamber disposed within the barrel for interconnecting a vent of each set of vents and for equalizing the pressures of the propellant gases at the inlets of said vents, said equalizing chamber including an annular groove disposed in the bore of the barrel;

(c) at least one flute extending parallel with the longitudinal axis of the barrel, each said flute extending radially outwardly from the bore of the barrel to a depth greater than that of any rifling which may exist in the barrel; and (d) thrust orifices distinct from the vents of said sets of vents and disposed in the upper half of the barrel for dissipating propellant gases generally upwardly.

2. The vent system as set forth in claim 1 wherein each said flute is diametrically opposed to one said set of vents and interconnects said equalizing chambers.

3. The vent system as set forth in claim 2 wherein each said vent is forwardly directed to dissipate the propellant gases forwardly and laterally.

4. The vent system as set forth in claim 3 wherein the upstream most ones of said thrust orifices are located forwardly of the upstream most ones of said vents, whereby the propellant gases exiting from said thrust orifices will mingle with the propellant gases exiting from the upstream ones of said vents and be directed forwardly.

5. A stabilizing vent system for venting a barrel of a firearm on discharge of the firearm, said vent system comprising in combination:

(a) three sets of vents disposed about the longitudinal axis of the barrel for balancing the force of the dissipating propellant gases in the lateral plane of the barrel, each of said set of vents including at least two vents longitudinally aligned with one another;

(b) an equalizing chamber for interconnecting a vent of each set of vents and for equalizing the pressures of the propellant gases at the inlets of said vents, said equalizing chamber including an annular groove disposed in the bore of the barrel;

(c) at least one flute for interconnecting said equalizing chambers, the depth of said equalizing chambers and said flutes being in correspondence to minimize flow disruption therebetween; and (d) thrust orifices disposed in the upper half of the barrel for dissipating propellant gases generally upwardly.

6. The vent system as set forth in claim 5 wherein each said vent inlet is coincident in width with the respective one of said equalizing chambers to minimize flow disruption therebetween.

7. The vent system as set forth in claim 6 wherein each said vent includes a forward wall, a rear wall and side walls and wherein each said thrust orifice includes an inlet, each said thrust orifice inlet being disposed in said rear wall of the immediate downstream one of said vents to minimize flow disruption into said thrust orifice.

8. The vent system as set forth in claim 7 wherein each of said vents is tapered to expand in cross-section toward the periphery of the barrel.

9. The vent system as set forth in claim 8 wherein the taper of the walls of said vents is in the range of 1–10 degrees.

10. The vent system as set forth in claim 8 wherein each of said thrust orifices is cone shaped and tapers to expand in cross-section toward the periphery of the barrel.

11. The vent system as set forth in claim 10 wherein the cone angle of said thrust orifices is 3 degrees.

12. The vent system as set forth in claim 8 wherein the forward orientation of said vents is in the range of 45–60 degrees with respect to the longitudinal axis of the barrel.

13. The vent system as set forth in claim 2 wherein the barrel includes rifling which rifling extends through said vent system except where the lands of the rifling would be coincident with said equalizing chambers and said flutes whereby, a projectile discharged.

14. The vent system as set forth in claim 2 wherein the barrel includes rifling for supporting a projectile upon passage past said vent system except where such rifling is coincident with said equalizing chambers or said flutes.

15. The vent system as set forth in claim 13 wherein the edges of said equalizing chambers are chamfered.

16. The vent system as set forth in claim 15 wherein the upstream ends of said flutes are chamfered.

17. The vent system as set forth in claim 2 wherein said flutes extend upstream of the equalizing chambers.

18. A stabilizing vent system for venting a barrel of a firearm on discharge of the firearm, said vent system comprising in combination:

(a) three sets of vents disposed about the longitudinal axis of the barrel for balancing the force of the dissipating propellant gases in the lateral plane of the barrel, each of said set of vents including at least two vents longitudinally aligned with one another;

(b) an equalizing chamber for interconnecting a vent of each set of vents and for equalizing the pressures of the propellant gases at the inlets of said vents, said equalizing chamber including an annular groove disposed in the bore of the barrel;

(c) at least one flute for interconnecting said equalizing chambers and extending upstream of said equalizing chambers with the upstream ends of said flutes being tapered; and (d) thrust orifices disposed in the upper half of the barrel for dissipating propellant gases generally upwardly.

19. The vent system as set forth in claim 18 wherein the upstream ends of said flutes are tapered in two dimensions.

20. A stabilizing vent system incorporated in and as part of a rifled barrel of a firearm for venting the rifled barrel on discharge of the firearm, said vent system comprising in combination:

(a) sets of vents disposed within the barrel and about the longitudinal axis of the barrel for dissipating the propellant gases, said sets of vents being oriented to dissipate the propellant gases forwardly and laterally;

(b) an equalizing chamber disposed within the barrel for interconnecting a vent of each set of said sets of vents and for equalizing the pressures of the propellant gases at the inlets of said interconnected vents, each said equalizing chamber including an annular groove disposed in the bore of the barrel;

(c) at least one flute extending parallel with the longitudinal axis of the barrel and interconnecting adjacent equalizing chambers, each said flute extending radially outwardly from the bore of the barrel to a depth greater than that of the rifling in the barrel;

(d) thrust orifices disposed in the upper half of the barrel for dissipating propellant gases generally upwardly;

(e) segmented lands of rifling disposed within the bore of the barrel interspersed with said vent system for supporting the discharged projectile during its passage through said vent system; and (f) rifling disposed within the bore of the barrel downstream of said vent system for supporting the projectile after passage past said vent system and prior to exit from the muzzle of the barrel.

21. The vent system as set forth in claim 22 wherein each of said set of vents includes at least two vents longitudinally aligned with one another and wherein said vent system includes at least one flute for interconnecting said equalizing chambers.

22. The vent system as set forth in claim 20 including a flute disposed in the bore of the barrel for interconnecting each of said equalizing chambers.

23. A stabilizing vent system for venting a rifled barrel of a firearm on discharge of the firearm, said vent system comprising in combination:

(a) sets of vents disposed about the longitudinal axis of the barrel for dissipating the propellant gases each of said set of vents including at least two vents longitudinally aligned with one another, said sets of vents being oriented to dissipate the propellant gases forwardly and laterally;

(b) an equalizing chamber for interconnecting a vent of each set of said sets of vents and for equalizing the pressures of the propellant gases at the inlets of said interconnected vents, said equalizing chambers including an annular groove disposed in the bore of the barrel;

(c) at least one flute disposed in the bore of the barrel for interconnecting said equalizing chambers, the depth of said equalizing chambers and said flutes being in correspondence to minimize flow disruption therebetween;

(d) thrust orifices disposed in the upper half of the barrel for dissipating propellant gases generally upwardly;

(e) segmented lands of rifling disposed within the bore of the barrel coincident with said vent system for supporting the discharged projectile during its passage through said vent system; and (f) rifling disposed within the bore of the barrel downstream of said vent system for supporting the projectile after passage past said vent system and prior to exit from the muzzle of the barrel.

24. The vent system as set forth in claim 23 wherein said flutes extend upstream of the equalizing chambers.

25. The vent system as set forth in claim 23 wherein each said vent inlet is coincident in width with the respective one of said equalizing chambers to minimize flow disruption therebetween.

26. The vent system as set forth in claim 25 wherein the upstream most ones of said thrust orifices are located forwardly of the upstream most ones of said vents, whereby the propellant gases existing from said thrust orifices will mingle with the propellant gases exiting from the upstream ones of said vents and be directed forwardly.

27. The vent system as set forth in claim 26 wherein each said vent includes a forward wall, a rear wall and side walls and wherein each said thrust orifice includes an inlet, each said thrust orifice inlet being disposed in said rear wall of the immediate downstream one of said vents to minimize flow disruption into said thrust orifice.

28. The vent system as set forth in claim 27 wherein each of said vents is tapered to expand in cross-section toward the periphery of the barrel.

29. The vent system as set forth in claim 28 wherein the taper of the walls of said vents is in the range of 1–10 degrees.

30. The vent system as set forth in claim 29 wherein each of said thrust orifices is cone shaped and tapers to expand in cross-section toward the periphery of the barrel.

31. The vent system as set forth in claim 24 wherein the upstream ends of said flutes are chamfered.

32. The vent system as set forth in claim 31 wherein the upstream ends of said flutes are tapered.

33. The vent system as set forth in claim 32 wherein the upstream ends of said flutes are tapered in two dimensions.

34. The vent system as set forth in claim 22 wherein each of said flutes is coincident with the inlets of one of said sets of vents.

35. The vent system as set forth in claim 20 wherein said sets of vents remain unconstricted by ancillary elements of the firearm during a substantial part of the discharge of the propellant gases through said sets of vents.

* * * * *